United States Patent [19]

Paul

[11] Patent Number: 4,873,809

[45] Date of Patent: Oct. 17, 1989

[54] CEILING TILE HOLD DOWN CLIP

[76] Inventor: Harold J. Paul, 2015 Magnolia Ave., Pensacola, Fla. 32503

[21] Appl. No.: 240,063

[22] Filed: Aug. 26, 1988

Related U.S. Application Data

[63] Continuation-in-part of Ser. No. 170,810, Mar. 21, 1988.

[51] Int. Cl.[4] ..... E04B 5/57

[52] U.S. Cl. ..... 52/489; 52/98; 52/772; 52/773

[58] Field of Search ..... 52/489, 715, 772, 773, 52/774

[56] References Cited

U.S. PATENT DOCUMENTS

| | | | |
|---|---|---|---|
| 1,385,217 | 7/1921 | Lutz | 52/773 X |
| 3,248,839 | 5/1966 | Roberts | 52/773 |
| 4,027,454 | 6/1977 | Schuplin | 52/489 X |
| 4,408,428 | 10/1983 | Brooke | 52/489 |

FOREIGN PATENT DOCUMENTS

| | | | |
|---|---|---|---|
| 732314 | of 1932 | France | 52/772 |
| 853426 | 11/1960 | United Kingdom | 52/773 |
| 2046344 | 12/1980 | United Kingdom | 52/715 |

*Primary Examiner*—David A. Scherbel
*Assistant Examiner*—Jerrold D. Johnson
*Attorney, Agent, or Firm*—George A. Bode

[57] ABSTRACT

A ceiling tile hold down clip which clips over the top horizontal portion of cross supports in a suspended ceiling system. Retaining arms with extending lower portion bear against the upper portion of the ceiling tile. Locking arms with an inwardly directed lip portion prevent easy removal of the clip.

3 Claims, 2 Drawing Sheets

CEILING TILE HOLD DOWN CLIP

BACKGROUND OF THE INVENTION

This application is a continuation-in-part application of a previous application by the same inventor bearing U.S. Ser. No. 07/170,810 filed Mar. 21, 1988. The entire previous application Ser. No. 07/170,810 is incorporated herein by reference as if set forth in full below.

1. Field of the Invention

The present invention relates generally to ceiling tile hold down clips and, more particularly, to clips for holding down ceiling tile sections of suspended ceilings.

2. General Background

When installing a suspended ceiling, wall runners are attached to the walls at the desired height around the room. Cross supports are then hung and interconnect with each other and the runners along the walls to form rectangles or squares of a pre-determined size equal to that of the ceiling tiles to be hung or suspended between the runners and cross supports. The wall runners are typically L-shaped, while the cross supports define somewhat of an I-shape with the lower horizontal portion being wider than the upper horizontal portion. (Some in the trade believe that such cross supports define an inverted T-shape, with each side of the cross support presenting an L-shape and this is the definition adopted in parent application Ser. No. 07/170,810 filed Mar. 21, 1988). The lower horizontal portions of the cross supports and the bottom of the L of the wall runners serve as supports for the ceiling tiles. Since the ceiling tile sections are held in position only by their own weight bearing down against the lower horizontal portions of the cross supports and the bottom of the L of the wall runners, which is relatively light when compared to their surface area, they are easily moved upward away from the desired installed position. To prevent this, it can be seen that a need exists for a device capable of holding down ceiling tile sections of a variety of thicknesses and which is usuable on the majority of suspended ceiling tile systems currently on the market.

SUMMARY OF THE PRESENT INVENTION

The preferred embodiment of the apparatus of the present invention solves the aforementioned problem in a straight forward and simple manner. What is provided is a ceiling tile hold down clip which clips over the top horizontal portion of the cross supports. The clip provides downward pressure againt the installed ceiling tile section to retain it in its installed position. Upward facing locking arms lock onto the upper horizontal portion of the cross support to prevent easy or unintentional removal of the ceiling tile. The clip is designed to provide retaining pressure on ceiling tile sections on each side of a cross support. The clip is also designed to retain its functionality even if it should be broken at its upper most portion.

In view of the above, it is an object of the present invention to provide a ceiling tile hold down clip for suspended ceiling tile sections which prevents easy removal of the installed tile sections.

It is another object of the present invention to provide a ceiling tile hold down clip which allows use of one-half of the clip.

BRIEF DESCRIPTION OF THE DRAWING

For a further understanding of the nature and objects of the present invention, reference should be had to the following description, taken in conjunction with the accompanying drawing, in which like parts are given like reference numerals and, wherein.

DETAILED DESCRIPTION OF THE PREFERRED EMBODIMENT

Figure 1:
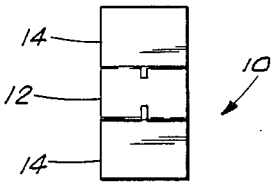
FIG. 1 is a top view of the preferred embodiment of the apparatus of the present invention.
Figure 3:
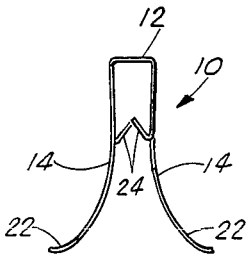
FIG. 3 is a side (or end) elevational view of the embodiment of FIG. 1.
Figure 2:
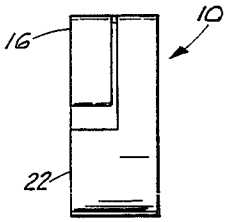
FIG. 2 is a front elevational view of the embodiment of FIG. 1.
Figure 4:
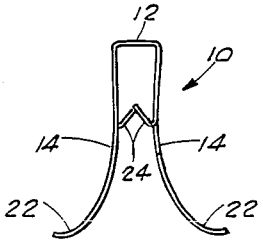
FIG. 4 is a side (or end) elevational view of the embodiment of FIG. 1, the side (or end) being the side opposite that shown in FIG. 3.
Figure 5:
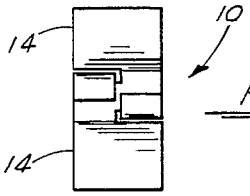
FIG. 5 is a bottom view of the embodiment of FIG. 1.
Figure 6:
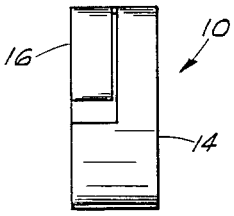
FIG. 6 is a rear elevational view of the embodiment of FIG. 1.
Figure 7:
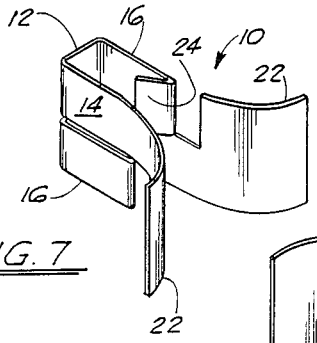
FIG. 7 is a bottom perspective view of the embodiment of FIG. 1.

Referring now to the drawing, and in particular FIGS. 1–8, the apparatus of the present invention is designated generally by the numeral 10. Ceiling tile hold down clip 10 is generally comprised of main body portion 12, ceiling tile section retaining arms 14, and locking arms 16.

Figure 8:
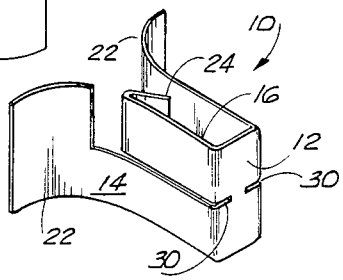
FIG. 8 is a top perspective view of the embodiment of FIG. 1.
Figure 9:
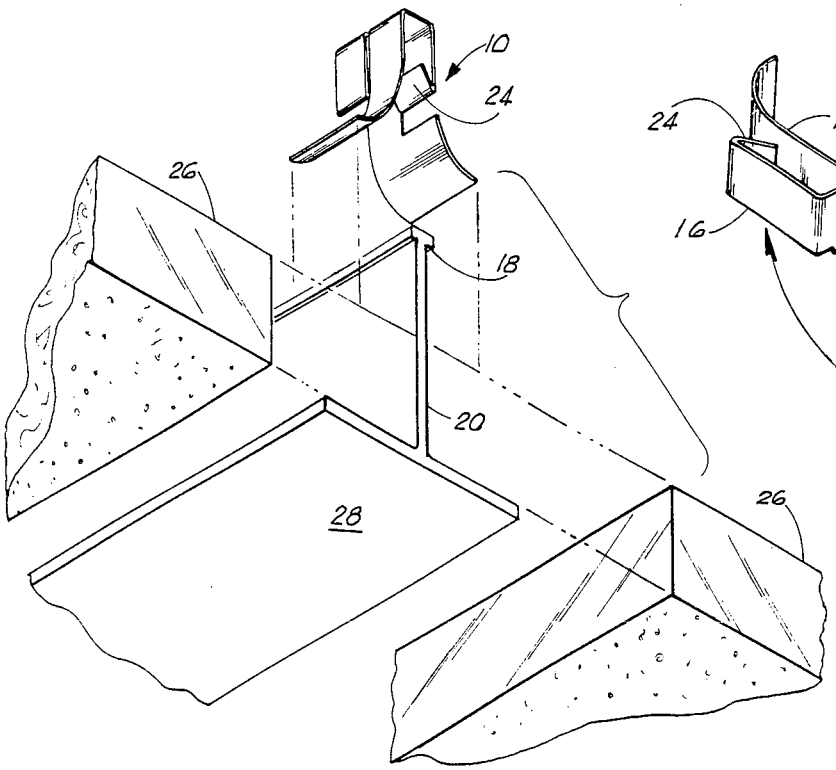
FIG. 9 illustrates the positioning of the embodiment of FIG. 1 immediately prior to installation of ceiling tile sections on a cross support and then installation of the present invention on the cross support and ceiling tile sections supported thereby.
Figure 10:
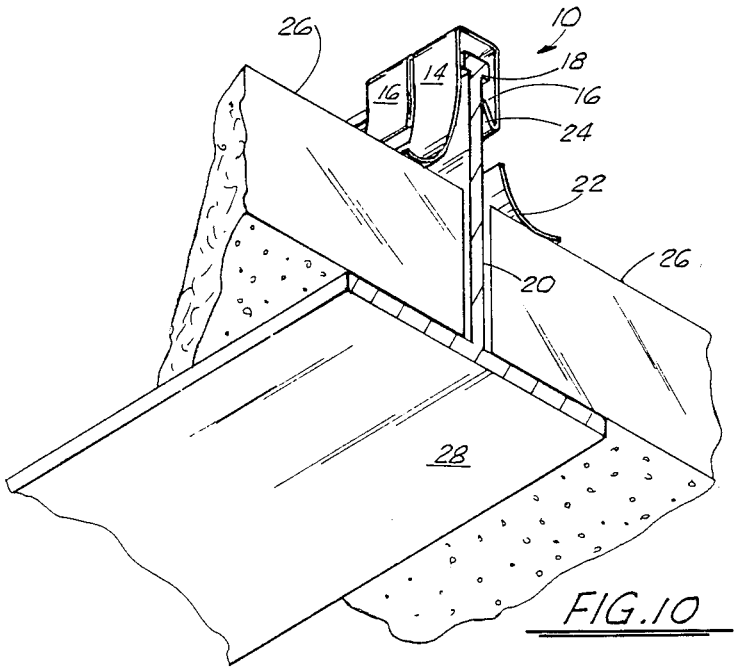
FIG. 10 illustrates the embodiment of FIG. 1 installed on a cross support and ceiling tile sections supported thereby.

Main body portion 12 is substantially rectangular and approximately equal to or slightly wider than upper horizontal portion 18 of cross support 20, best seen in FIGS. 9 and 10. Main body portion 12, retaining arms 14 and locking arms 16 are preferrably integrally formed from a flexible material such as spring steel to allow bending while maintaining the tendency to return to their original preformed shape. Retaining arms 14 and locking arms 16 extend downwardly from main body portion 12 and are preferrably integral therewith. In the perferred embodiment, two (2) retaining arms 14 are provided. As best seen in FIGS. 3 and 4 and 7–9, retaining arms 14 extend downwardly from opposite ends and sides of main body portion 12. Retaining arms 14 are provided with lower portions 22 which extend or flare outwardly away from main body portion 12. Lower portions 22 are also wider than the top portions of retaining arms 14 (approximately twice as wide) and approximately equal the length of main body portion 12. Lower portions 22 thus flare outwardly from main body portion 12 in a direction substantially diametrically opposed to each other.

In the preferred embodiment, two (2) locking arms 16 are provided. As best seen in FIGS. 3 and 4 and 7–9, locking arms 16 extend downwardly from opposite ends and sides of main body portion 12 adjacent retaining arms 22. Locking arms 16 are each provided with a lip portion 24 which extends inwardly and upwardly toward main body portion 12. As illustrated in FIG. 10, when clip 10 is installed, lip portions 24 prevent direct upward removal of clip 10 since lip portions 24 engage the under side of upper horizontal portion 18 of cross support 20.

Figure 11:
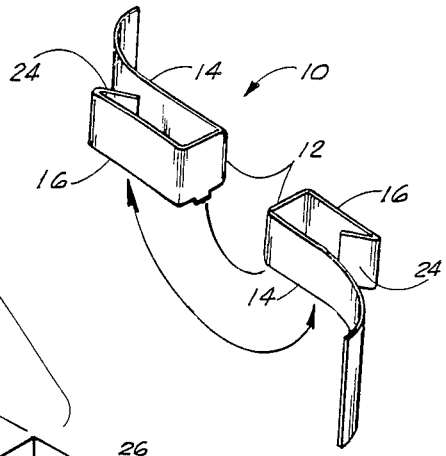
FIG. 11 illustrates the embodiment of FIG. 1 broken in half.
Figure 12:
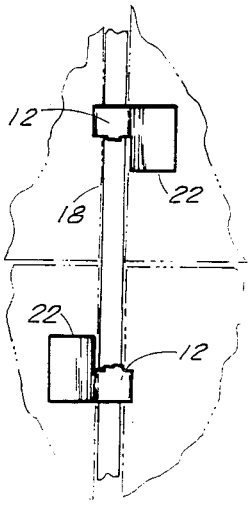
FIG. 12 is a top view illustrating the embodiment of FIG. 11 installed on a cross support and ceiling tile sections supported thereby.

Use of apparatus 10 is best illustrated in FIGS. 9–12. Cross supports 20 are installed. Ceiling tile sections 26 are then installed on lower horizontal portion 28 of cross support 20. Clip 10 is then placed over cross support 20 as seen in FIG. 9 and forced down into the position illustrated in FIG. 10. Retaining arms 22 bear downwardly against ceiling tile sections 26 to maintain them in their installed position. The resiliency of the material of clip 10 allows retaining arms 22 to flex to accomodate ceiling tile sections 26 of varying thickness. Lip portions 24 of locking arms 16 are allowed to pass over upper horizontal portion 18 of cross support 20 by flexing of locking arms 16. Lip portions 24 then prevent upward removal of clip 10 by engagement with the under side of upper horizontal portion 18. As best seen in FIGS. 8, 11 and 12, main body portion 12 is provided with slots 30 which allow clip 10 to be broken in half without destroying its function as a hold down clip. Each retaining arm 14 and locking arm 16 remain paired on opposite sides of main body portion 12 with its counterpart to provide the necessary hold down function.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A ceiling tile hold down clip, comprising:

(a) a substantially rectangular main body portion;

(b) an arcuately shaped retaining arm extending downwardly and outwardly from a first side of said main body portion, said retaining arm being wider at its lower portion than at its upper portion; and, (c) a locking arm extending downwardly from the side opposite said first side of said main body portion, said locking arm being in a position opposed and substantially parallel to said retaining arm at the portions of said arms proximate said main body portion and, said locking arm having proximate and distal ends, and having at its distal end a lip portion extending inwardly toward said retaining arm and upwardly toward said main body portion.

2. A ceiling tile hold down clip, comprising:

(a) a substantially rectangular main body portion;

(b) a pair of arcuately shaped spaced apart retaining arms extending downwardly and outwardly from diagonally positioned portions of opposing lateral sides of said main body portions, each of said retaining arms having lower and upper portions, said lower portion being substantially widened with respect to said upper portion;

(c) a pair of locking arms extending downwardly from portions of the opposing sides of said main body portion and positioned opposed and substantially parallel to said retaining arms at the upper portions of said retaining and locking arms, each of said locking arms having proximate and distal ends, and having at its distal end a lip portion which extends inwardly toward said opposed retaining arm and upwardly toward said main body portion.

3. A ceiling tile hold down clip for mounting on the cross support of a plurality of ceiling tile sections, said clip comprising:

(a) a substantially flat rectangular main body portion, thus defining opposing lateral sides and edges;

(b) a pair of arcuately shaped spaced apart retaining arms extending downwardly and outwardly from diagonally positioned portions of the opposing lateral sides of said main body portion, said retaining arms having lower and upper portions, said lower portion being substantially widened with respect to said the upper portion thereof, but widened no further than said edges of said main body portion, and adapted for engaging with its lower concave surface the upper surface of one of said ceiling tile sections; and, (c) a pair of locking arms extending downwardly from opposing sides of said main body portion and positioned opposed and substantially parallel to said retaining arms at the upper portions of said retaining and locking arms, each of said locking arms having proximate and distal ends, and having at its distal end a lip portion which extends inwardly toward said opposed retaining arm and upwardly toward said main body portion for engaging said cross support of said ceiling tile section.

* * * * *